US011346211B2

(12) United States Patent
Newhouse

(10) Patent No.: US 11,346,211 B2
(45) Date of Patent: May 31, 2022

(54) SYSTEMS AND METHODS FOR CONDUCTING A WELL INTERVENTION OPERATION

(71) Applicant: Halliburton Energy Services, Inc., Houston, TX (US)

(72) Inventor: Lori A. Newhouse, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/052,067

(22) PCT Filed: Jun. 22, 2018

(86) PCT No.: PCT/US2018/038943
§ 371 (c)(1),
(2) Date: Oct. 30, 2020

(87) PCT Pub. No.: WO2019/245575
PCT Pub. Date: Dec. 26, 2019

(65) Prior Publication Data

US 2021/0238986 A1 Aug. 5, 2021

(51) Int. Cl.
*E21B 47/007* (2012.01)
*E21B 47/09* (2012.01)
(Continued)

(52) U.S. Cl.
CPC ..... *E21B 47/09* (2013.01); *E21B 47/007* (2020.05); *E21B 19/08* (2013.01); *E21B 19/22* (2013.01)

(58) Field of Classification Search
CPC ..... E21B 19/08; E21B 19/22; E21B 47/007; E21B 47/009
See application file for complete search history.

(56) References Cited

U.S. PATENT DOCUMENTS 6,443,242 B1 9/2002 Newman
9,567,836 B2 2/2017 Jamison
(Continued)

FOREIGN PATENT DOCUMENTS

WO 2013074093 A1 5/2013

OTHER PUBLICATIONS

International Search Report and Written Opinion dated Mar. 20, 2019 for PCT Application No. PCT/US2018/038943 filed Jun. 22, 2018. (11 pages).

*Primary Examiner* — Robert E Fuller
*Assistant Examiner* — Lamia Quaim
(74) *Attorney, Agent, or Firm* — K&L Gates LLP

(57) ABSTRACT

Systems and methods for conducting a well intervention operation in a well include positioning a conveyance into the well for the well intervention operation, calculating a predicted force based at least in part on a length of the conveyance that is positioned at a depth in the well, measuring a measured force for the conveyance at the depth in the well, and comparing a predicted force for the conveyance at the depth in the well with the measured force in real time to determine if the predicted force is within a predetermined range of the measured force in real time. The method further includes generating an alert if the predicted force is not within the predetermined range of the measured force in real time, and continuing with the well intervention operation if the predicted force is within the predetermined range of the measured force.

20 Claims, 3 Drawing Sheets

(51) Int. Cl.
*E21B 19/08* (2006.01)
*E21B 19/22* (2006.01)

(56) References Cited

U.S. PATENT DOCUMENTS

| | | | | |
|---|---|---|---|---|
| 2006/0096753 | A1* | 5/2006 | Zheng | E21B 17/20 166/250.01 |
| 2011/0144960 | A1 | 6/2011 | Weng | |
| 2013/0124166 | A1 | 5/2013 | Clemens | |
| 2015/0129306 | A1 | 5/2015 | Coffman et al. | |
| 2016/0281490 | A1* | 9/2016 | Samuel | E21B 7/10 |
| 2016/0314420 | A1 | 10/2016 | Livescu | |
| 2016/0362973 | A1* | 12/2016 | Turner | E21B 17/20 |

* cited by examiner

SYSTEMS AND METHODS FOR CONDUCTING A WELL INTERVENTION OPERATION

BACKGROUND

This section is intended to provide relevant contextual information to facilitate a better understanding of the various aspects of the described embodiments. Accordingly, it should be understood that these statements are to be read in this light and not as admissions of prior art.

Exploring, drilling, and completing hydrocarbon and other wells are generally complicated, time consuming and ultimately very expensive endeavors. Due to these factors, an emphasis is often placed on well access in the hydrocarbon recovery industry. That is, access to a well at an oilfield for monitoring its condition and maintaining its proper health is of greater importance. As described below, such access to the well is often provided by way of coiled tubing or slickline as well as other forms of well access lines.

Well access lines as noted may be configured to deliver interventional or monitoring tools downhole. In the case of coiled tubing and other tubular lines, fluid may also be accommodated through an interior thereof for a host of downhole applications. Coiled tubing is particularly well suited for being driven downhole through a horizontal or tortuous well, to depths of perhaps several thousand feet, by an injector at the surface of the oilfield. With these characteristics in mind, the coiled tubing will also generally be of sufficient strength and durability to withstand such applications. For example, the coiled tubing may be of alloy steel, stainless steel or other suitable metal or non-metal material.

With this construction, the coiled tubing is plastically deformed and wound about a drum to form a coiled tubing reel for delivery to the oilfield for use in a well treatment or intervention operation. The coiled tubing, however, is prone to develop natural wear and defects. For example, repeated plastifying deformation as noted above may lead to wear and cracking. Further, pinhole and other defects may emerge at different locations of the coiled tubing as it is abrasively and forcibly advanced through a tortuous well.

Once more, independent of the durability, the coiled tubing is limited by a maximum overall reach when being advanced through a horizontal well. More specifically, a well may have sections that are deviated or curved to transition from a generally vertical section of the well to a generally horizontal section. Thus, as the coiled tubing encounters the elbow, initial resistance to advancement emerges. This resistance continues in the form of friction for the remaining depth of the well. Therefore, given advancing well depths, it may be desired to for operators to have access to real-time data, feedback, and other metrics to monitor the status of a coiled tubing or other conveyance within a well for a given well intervention operation.

BRIEF DESCRIPTION OF THE DRAWINGS

Illustrative embodiments of the present disclosure are described in detail below with reference to the attached drawing figures, which are incorporated by reference herein and wherein.

Figure 1:
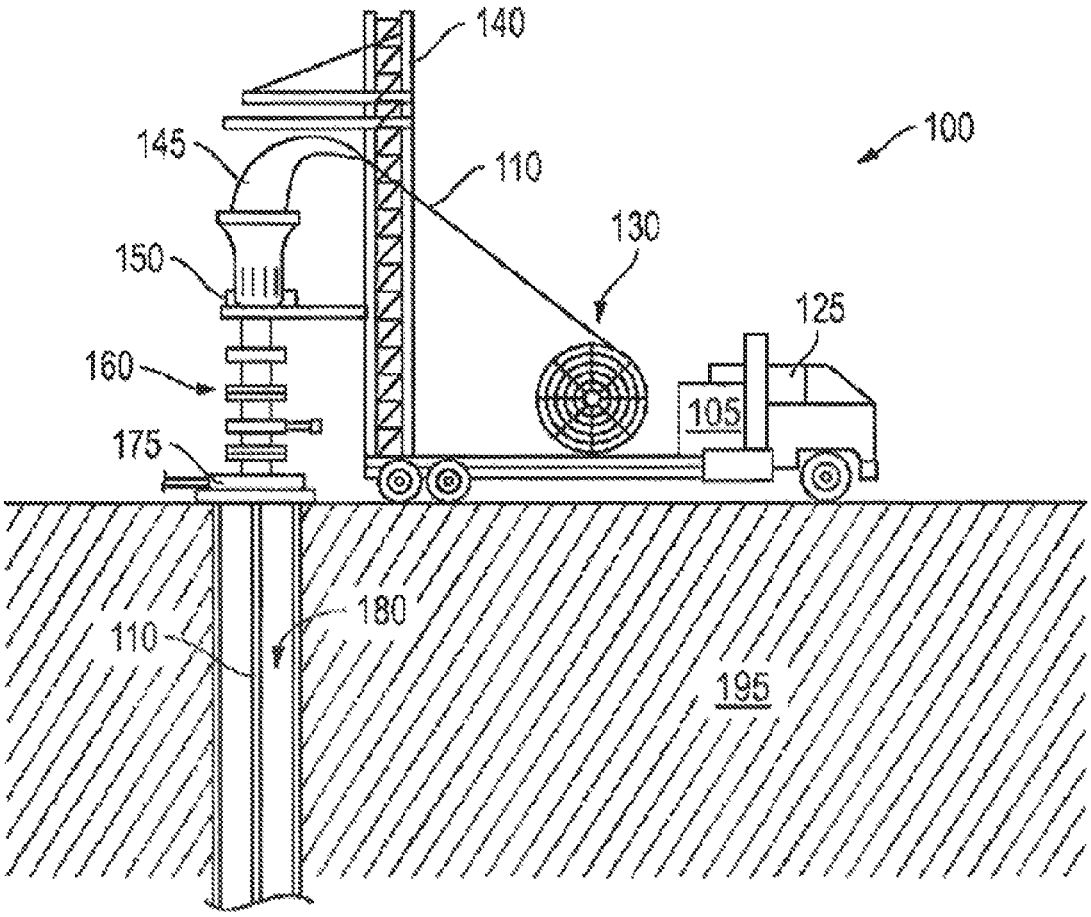
FIG. 1 shows schematic view of a well intervention operation in accordance with one or more embodiments of the present disclosure.

The illustrated figures are only exemplary and are not intended to assert or imply any limitation with regard to the environment, architecture, design, or process in which different embodiments may be implemented.

DETAILED DESCRIPTION OF ILLUSTRATIVE EMBODIMENTS

The present disclosure generally relates to oil and gas well intervention operations, and more particularly to systems and methods for real-time conducting of a well intervention operation. As used herein, a "conveyance" may include any pipe, such as drill pipe or hydraulic workover pipe; tubing, such as coiled tubing or flexible tubing; cable, such as an electrical wire, such as slickline, wireline, or a wire included within flexible tubing; or other elongated structure that is used to position a tool or other device down into the well or retrieve the tool or other device from the well. As used herein, a well "intervention operation" includes, but is not limited to, a drilling operation, a perforating tubing operation, a pumping and stimulation operation, a sand control completion operation, a well control operation, a snubbing operation, a recompletion operation, and/or an abandonment and well evaluation operation, or any combinations of these.

The method involves measuring a force that the conveyance in the well provides to a measuring device at a surface of the well. The force may take into account the weight of the conveyance, buoyancy of the conveyance, fluid resistance as the conveyance moves through the fluid in the well, fluid being pumped into the conveyance, or other factors that influence the conveyance. The force may also be either placing the conveyance in compression or tension. A predicted force may be compared with the measured force that is actually being read at the surface of the well. If the measured force is not within a predetermined range of the predicted force, then an alert may be generated and the remainder of the job plan for the well intervention operation may be evaluated with respect to the new information and data of the well.

Previous attempts to position a conveyance in a well may have resulted in the conveyance getting stuck while running into the well, and yielding or breaking while pulling out of the well. The disclosed embodiments enable real time determination of how far, or how strongly, the conveyance may be pushed into or pulled out of the well without getting stuck, buckling, yielding, breaking, or other failure. Unconventional real time measurements and comparisons speed up the recognition of potential problems, which can prevent the problems from increasing in complexity.

A subterranean formation containing oil or gas hydrocarbons may be referred to as a reservoir, in which a reservoir may be located under land or off shore. Reservoirs are typically located in the range of a few hundred feet (shallow reservoirs) to a few tens of thousands of feet (ultra-deep reservoirs). To produce oil or gas or other fluids from the reservoir, a wellbore is drilled into a reservoir or adjacent to a reservoir.

A well can include, without limitation, an oil, gas, or water production well, or an injection well. As used herein, a "well" includes at least one wellbore having a wellbore wall. A wellbore can include vertical, inclined, and horizontal portions, and it can be straight, curved, or branched with one or more extensions, such as multiple lateral wellbores extending from a main wellbore. As used herein, a "wellbore" may include any cased, and any uncased, open-hole portion of the wellbore. A "near-wellbore region" includes the subterranean material and rock of the subterranean formation surrounding the wellbore. As used herein, a well may also include the near-wellbore region. The near-wellbore region is generally considered to be the region within approximately 100 feet of the wellbore.

A portion of a wellbore may be an open-hole or cased-hole. In an open-hole wellbore portion, a tubing string may be placed into the wellbore. The tubing string allows fluids to be introduced into or flowed from a remote portion of the wellbore. In a cased-hole wellbore portion, a casing is placed into the wellbore that can also contain a tubing string.

Referring now to FIG. 1, a schematic view of a well intervention operation 100 for a well 180 in accordance with one or more embodiments of the present disclosure is shown. A conveyance, such as coiled tubing 110, is shown positioned into the well 180 with the remainder of the coiled tubing 110 included on a coiled tubing reel 130.

The coiled tubing 110 and the reel 130 are delivered to the well 180 by way of a mobile coiled tubing truck 125. Of course, in alternate embodiments other delivery mechanisms and platforms, particularly for other types of conveyances, may be employed, such as a conventional skid used in on-shore applications and a vessel used in off-shore applications. A rig 140 is provided along with a conventional gooseneck injector 145 for forcibly driving the coiled tubing 110 through valve and pressure control equipment 160 to advance the tubing 110 past the well head 175 and into the well 180 for the well intervention operation 100.

In the embodiment shown, the well 180 initially traverses a formation 195 in a vertical manner. However, as detailed above, the well 180 may be of fairly extensive reach, eventually traversing the formation horizontally, and/or may have one or more extensions, such as multiple lateral wellbores extending from a main wellbore. The system 100 may further include a measuring device 150, such as below the injector 145 shown here, or on the reel 130, to measure the force of the coiled tubing 110 extending into the well 180. The measuring device 150 may include redundant devices that also measure the force of the coiled tubing 110. The additional devices may measure the force in the same, or in different ways (e.g., mechanical and electrical force measurement).

Figure 2:
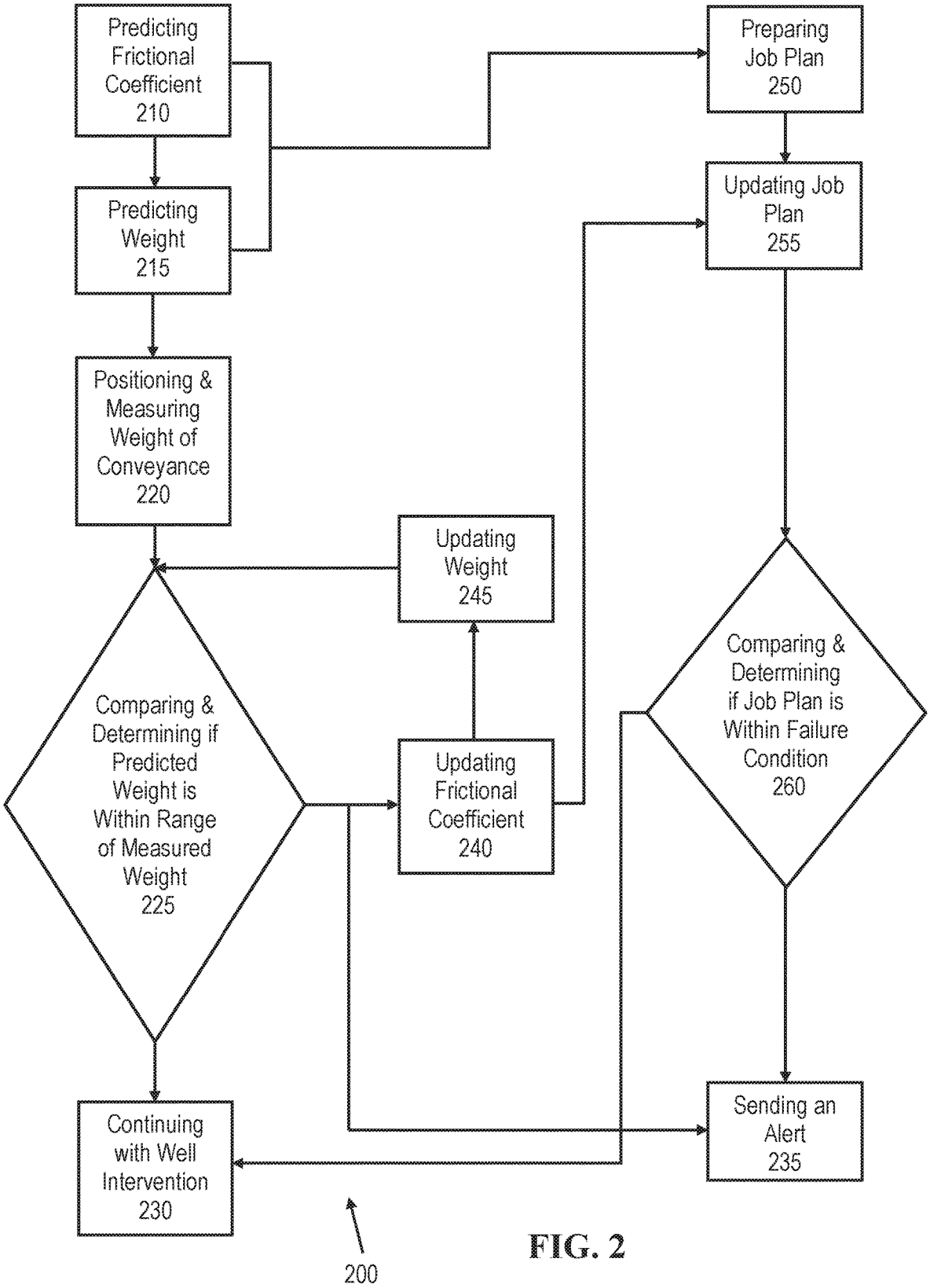
FIG. 2 shows flowchart of a method of conducting a well intervention operation in a well in real-time in accordance with one or more embodiments of the present disclosure.

Referring now to FIG. 2, a flowchart of a method 200 of conducting a well intervention operation in a well in real-time in accordance with one or more embodiments is shown. The method 200 is used to monitor, in particular, a conveyance used in a well intervention operation, such as the coiled tubing 110 used in the well 180 for the well intervention operation 100 in FIG. 1.

The method 200 includes predicting a wall friction coefficient 210 for the friction between the outer surface of the conveyance interacting with the wellbore wall as the conveyance is being moved within the wellbore. The wall friction coefficient 210 is based upon one or more known frictional parameters or properties, such as the conveyance, the well, and/or history matched data of similar and previously-run well intervention operations. For example, the type, size, and/or shape of the conveyance affects the wall friction coefficient, and the type, size, shape, geometry, and/or deviation of the well also affects the wall friction coefficient. For example, the wall friction coefficient is expected to be higher for a well that is open-hole or extending horizontal and lower for a well that is cased-hole or extending vertically. Further, elements positioned in the well along with the conveyance may also affect the wall friction coefficient. Other tubulars or tools in the well may also increase the wall friction coefficient at a specific location, as may non-homogeneous structure of the conveyance. Frictional reducers or lubricants may be added to a well fluid, or appended to the conveyance or the well to reduce the wall friction coefficient. These elements may be positioned only at certain locations such that the total value of the frictional force changes in a non-linear way as the conveyance descends in the well. Furthermore, wall friction coefficients, the locations of elements affecting the frictional force, and similar data from previously-run well intervention operations with similar wells and circumstances may be used for predicting the wall friction coefficient 210 for the conveyance in the current well for the current well intervention operation.

In addition to the above, a well and a well intervention operation may have variations in wall friction coefficients, such as for different portions or sections of the well or for different portions of the well intervention operation. For example, one wall friction coefficient (i.e., additive over a given length) may be used for a generally horizontal section of the well, while a second frictional force may be used for a generally vertical section of the well. Further, a different wall friction coefficient may be used for when a conveyance is positioned into the well, or different portions of the well, than when the conveyance is retrieved from the well. Thus, the present disclosure is not limited to only a single wall friction coefficient, or force per length, as the conveyance may interact with the well differently in different portions to define multiple wall friction coefficients.

The method 200 includes calculating a predicted force 215 for the deployed conveyance and any device conveyed by the conveyance. The predicted force is calculated, for example, by a processor that may be located at the surface of the well. The processor may predict and/or calculate the predicted force based on factors such as density of the conveyance, the length that has been positioned into the well, the expected buoyancy based on known or predicted fluids, and well conditions stored from previous operations in the well or similar wells (e.g., neighboring wells or wells in the same reservoir. The predicted force may be adjusted in real time as the depth of the conveyance changes in the well, and also adjusted based upon the value of the predicted wall friction coefficient and potentially other factors in real time. For example, using the predicted wall friction coefficient, the predicted force of the conveyance measured from the surface of the well may be reduced due to the frictional force counteracting the downward pull of the gravitational force on the conveyance. Other factors in addition to the wall friction coefficient may also be used to calculate the predicted force of the conveyance, such as the density of fluid within the well, the pressure of the fluid within the well, and/or a pump rate of the fluid within the well.

Referring still with FIG. 2, the method 200 includes positioning and measuring the force of the conveyance 220 in the well and comparing and determining if the predicted force is within a range (e.g., predetermined or acceptable range) of the measured force 225. In particular, the conveyance is positioned in the well at a depth for the well intervention operation, and the measured force of the conveyance is measured (e.g., by the measuring device 150) at the surface of the well. Once the measured force of the conveyance is measured, the predicted force for the conveyance at the depth is compared with the measured force. For example, a processor (i.e., illustrated in FIG. 3) may compare the measured force and the predicted force. The processor may generate a value for the comparison for review by an operator, or generation of an action by the well intervention operation. Based upon the comparison, the processor may determine if the predicted force is within a predetermined range or acceptable range of the measured force. For example, the predetermined range for the measured force may be plus or minus five percent of the predicted force. The predetermined range may also be plus or minus ten percent. So if the measured force is within plus or minus five percent or plus or minus 10 percent of the predicted force for the depth of the conveyance, then the well intervention operation 100 will continue positioning the conveyance. The comparison, as well as the predetermined range may be displayed on an output device such that a visual indication of the comparison is available visually.

If the predicted force is within the predetermined range of the measured force, the method 200 includes continuing with the well intervention operation 230. Continuing with the well intervention indicates that the well intervention operation is within a predetermined factor of safety and that the conveyance within the well may still be used according to a job plan (discussed more below). For example, continuing with the well intervention may include continuing to position the conveyance into the well, or continuing to pull the conveyance out of the well. Additionally or alternatively, continuing with the well intervention may include performing other functions such as a drilling operation, a perforating tubing operation, a pumping and stimulation operation, a sand control completion operation, a well control operation, a snubbing operation, a recompletion operation, and/or an abandonment and well evaluation operation, or any combinations of these. Further, at a later time, the method 200 may include measuring the force of the conveyance 220 and comparing and determining if the predicted force is within a range (e.g., predetermined or acceptable range) of the measured force 225 to still verify that the well intervention operation is within a predetermined factor of safety still. The measurement of the force, the predicted force, a comparison of the measured versus the predicted force, or any combination thereof may be displayed on an output device such as a display or a sensor reading device.

If the predicted force is not within the predetermined range of the measured force, then an alert may be generated 235 to identify that a potential issue has arisen. Generating the alert 235 may involve sounding an alarm, such as a physical, visual, or audio alarm at the well or an alarm to a remote location of an engineer or related personnel conducting the well and the intervention operation. When an alert identifying that a potential issue is generated, the method may also involve automatically stopping the well intervention operation.

In addition or in alternative to generating the alert 235, the method 200 includes a loop of updating the wall friction coefficient 240, updating the predicted force 245, and comparing and determining (e.g., with the processor detailed in FIG. 3) if the predicted force is within the appropriate range of the measured force 225. In particular, if the predicted force is not within the predetermined range of the measured force, the wall friction coefficient predicted in step 210 is updated in step 240 based upon the comparison of the predicted force with the measured force. For example, if the predicted force is higher than the measured force by more than the predetermined range, then the wall friction coefficient may be lowered, such as by an amount proportional to the difference between the predicted force and measured force. Similarly, if the predicted force is lower than the measured force by more than the predetermined range, then the wall friction coefficient may be raised, such as by an amount proportional to the difference between the predicted force and measured force.

The wall friction coefficient may be updated for one portion or section of the conveyance within the well, or may be updated for multiple different portions of the conveyance within the well. This update, again, may be based upon the comparison of the predicted force with the measured force and may be done in real time. If the predicted force was within the predetermined range of the measured force for a first portion of the conveyance within the well, but then was not within the predetermined range for a second portion of the conveyance within the well, then only the wall friction coefficient for the second portion may be updated as appropriate. The wall friction coefficient may be updated in real time as data about the operation is conveyed and recorded by the processor at the surface. Furthermore, coiled tubing behavior, including the likelihood of the coiled tubing getting stuck or yielding, may also be predicted for the remainder of the planned job based on the recorded comparison of the measured force and the predicted force.

Once the wall friction coefficient is updated 240, the method 200 includes updating the predicted force 245 at the depth in the well based upon the updated frictional coefficient. The predicted force will increase if the updated wall friction coefficient is increased, and will decrease if the updated wall friction coefficient is decreased. The predicted force also depends on if the conveyance is being positioned into the well or retrieved from the well, in that the predicted force will increase if the conveyance is being positioned into the well, and will decrease if the updated wall friction coefficient is decreased. The method 200 then loops to continue with comparing and determining if the (e.g., updated) predicted force is within the range of the measured force 225. If the updated predicted force is within the predetermined range of the measured force, the method 200 may include continuing with the well intervention operation 230. If the predicted force is not within the predetermined range of the measured force, then an alert may be generated 235. Additionally or alternatively, the wall friction coefficient may continue to be updated 240, with the force continuing to be updated 245, and the predicted force compared with the measured force to determine if within range of each other 225. The method 200, thus, may be performed until an appropriate predicted wall friction coefficient is determined for the well intervention operation and is within a predetermined range.

Referring still to FIG. 2, the method 200 further includes preparing a job plan 250 for the well intervention operation based upon the predicted wall friction coefficient 210 and/or the predicted force 215, which may be prepared before or after the well intervention operation begins. A job plan for the well intervention operation includes details on the conveyance, such as how the conveyance will be used and if the conveyance will need to be replaced. The job plan provides significant benefit over previous attempts to perform well operations due to the real time adjustment that may accompany the immediate determination that the expectations in the job plan are not the actual measured results. For example, for a well intervention operation involving coiled tubing, the coiled tubing has a known or predetermined lifespan or failure conditions, so a job plan is prepared based upon these factors. A relatively sturdier, thicker, and more robust conveyance (e.g., coiled tubing) would be needed for a relatively higher wall friction coefficient and force than a lower wall friction coefficient and force. Further, if a conveyance has been used in previous well intervention operations, then the remainder of the useful life for the conveyance may be expected to be relatively lower.

Furthermore, the job plan may include one or more different failure condition or failure criteria. A failure condition may include the conveyance experiencing stress, strain, and/or yield above a predetermined amount, the conveyance locking-up in the well (e.g., a wall friction coefficient is too high, preventing the conveyance from being able to move within the well), or the conveyance separating from a component in the well (e.g., the conveyance disconnecting from a tool when being retrieved from the well). The job plan can involve using a more robust conveyance if the stress, strain, and/or yield is expected to be above a predetermined amount, or using a friction reducer if the wall friction coefficient is expected to be above a predetermined amount. A friction reducer may include a liquid or lubricant that interacts with the conveyance to reduce the wall friction coefficient in the well. A friction reducer may additionally or alternatively include placing one or more rollers or rolling members on the conveyance or a component (e.g., tool) connected to the conveyance. The job plan may also involve replacing a conveyance for a portion or for some task of the job plan to meet different criteria for the plan. Thus, these factors and other factors may be used in preparing the job plan 250.

After the job plan is prepared 250, the job plan may be updated 255, particularly if the wall friction coefficient is updated 240. For example, as discussed above, if the predicted force is not within the predetermined range of the measured force, the wall friction coefficient for the conveyance in the well may be updated 240 based upon the comparison of the predicted force with the measured force. As the job plan is prepared 250 based upon the frictional coefficient, the job plan may be updated 255 as the wall friction coefficient is updated.

After the job plan is updated 255, the method 200 further includes comparing and determining if the job plan is within a failure condition 260, such as for the conveyance or for the well intervention operation. As discussed above, a failure condition may include the conveyance experiencing stress, strain, and/or yield above a predetermined amount, or the conveyance from locking-up in the well. The job plan was initially planned 250 based upon an initial or predicted wall friction coefficient for the conveyance, the well, and/or the well intervention operation. The job plan was also initially planned 250 based upon an initial or predicted failure condition. As the job plan is then updated 255 as the wall friction coefficient is updated, the updated job plan may be compared again and is within the failure condition 260. For example, if a wall friction coefficient is higher than originally predicted, the conveyance may experience higher stress, strain, and/or yield than originally predicted. If this stress, strain, and/or yield is now more than the predetermined amount, it may be determined that the job plan is within the failure condition. If the stress, strain, and/or yield is still less than the predetermined amount, it may be determined that the job plan is not within the failure condition.

If the updated job plan is not within the failure condition, the method 200 may include continuing with the well intervention operation 230. This indicates that the conveyance for the well intervention operation is within a predetermined factor of safety and that the conveyance within the well may still be used according to the job plan (discussed more below). If the updated job plan is within the failure condition, then an alert may be generated 235 to identify that a potential issue has arisen for conveyance and the well intervention operation. Additionally or alternatively, if the updated job plan is within the failure condition, the method 200 may include continuing to update the job plan 255 and comparing the updated job plan with the failure condition 260 until the updated job plan is not within the failure condition. For example, remediation options if the failure condition is predicted may include removing the conveyance from the well earlier than expected, replacing the conveyance with a sturdier or more robust conveyance, altering the well intervention operation, introducing friction reducers into the well or well intervention operation, and/or other remediation options for the conveyance, well, or well intervention operation.

Figure 3:
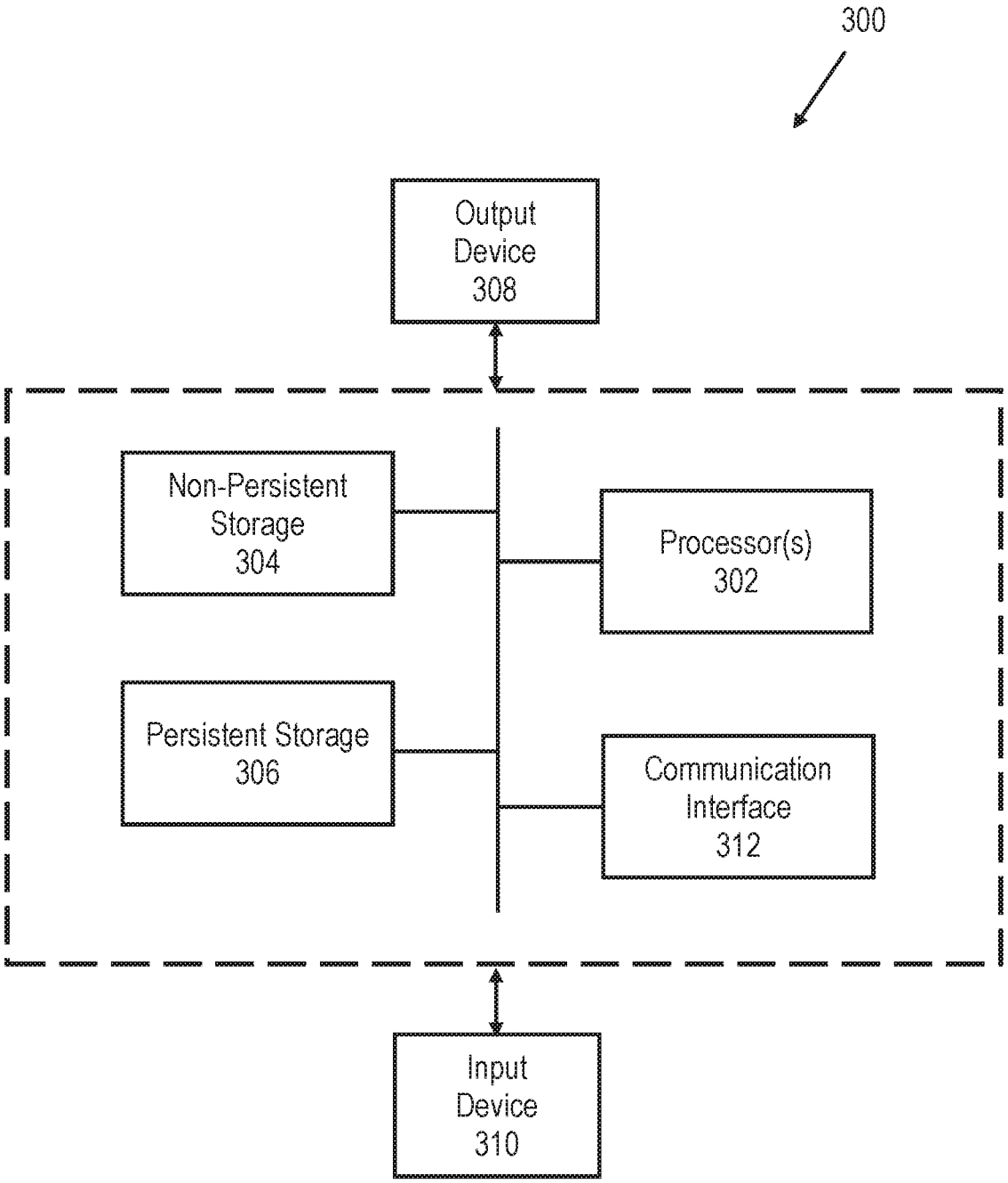
FIG. 3 shows a diagram of a computing device in accordance with one or more embodiments of the present disclosure.

Referring now to FIG. 3, a diagram of a computing device 300 in accordance with one or more embodiments of the present disclosure is shown. The computing device 300 may include one or more computer processors 302, non-persistent storage 304 (e.g., volatile memory, such as random access memory (RAM), cache memory), persistent storage 306 (e.g., a hard disk, an optical drive such as a compact disk (CD) drive or digital versatile disk (DVD) drive, a flash memory, etc.), a communication interface 312 (e.g., Bluetooth interface, infrared interface, network interface, optical interface, etc.), input devices 310, output devices 308, and numerous other elements (not shown) and functionalities. The computer processor(s) 302 may be an integrated circuit for processing instructions. For example, the computer processor(s) may be one or more cores or micro-cores of a processor. The computing device 300 may also include one or more input devices 310, such as a touchscreen, keyboard, mouse, microphone, touchpad, electronic pen, or any other type of input device. Further, the communication interface 312 may include an integrated circuit for connecting the computing device 300 to a network (not shown) (e.g., a local area network (LAN), a wide area network (WAN) such as the Internet, mobile network, or any other type of network) and/or to another device, such as another computing device.

Further, the computing device 300 may include one or more output devices 308, such as a screen (e.g., a liquid crystal display (LCD), a plasma display, touchscreen, cathode ray tube (CRT) monitor, projector, or other display device), a printer, external storage, or any other output device. One or more of the output devices may be the same or different from the input device(s). The input and output device(s) may be locally or remotely connected to the computer processor(s) 302, non-persistent storage 304, and persistent storage 306. Many different types of computing devices exist, and the aforementioned input and output device(s) may take other forms.

The present disclosure may be used to help identify and monitor the status of a well intervention operation, and more so the conveyance used within a well intervention operation, in real-time. For example, previously a job plan for a conveyance, though developed and prepared ahead of the well intervention operation, may not consider additional factors and real-time information as the well intervention operation consummates. In particular, a wall friction coefficient for a conveyance within a well for a well intervention operation is initially predicted, but this wall friction coefficient may not be updated, thereby updating the job plan, as the well intervention operation takes place. The present disclosure contemplates updating the predicted wall friction coefficient in real-time during the well intervention operation. This frictional coefficient, as it is used to prepare the job plan, may be used to also update the job plan as the wall friction coefficient must be updated. As the job plan is updated, this may be continuously compared with failure conditions to generate an alert to prevent potential failures within the well intervention operation.

In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time-consuming, but would nevertheless be a routine undertaking of design, fabrication, and manufacture for those of ordinary skill having the benefit of this disclosure.

Certain terms are used throughout the description and claims to refer to particular features or components. As one skilled in the art will appreciate, different persons may refer to the same feature or component by different names. This document does not intend to distinguish between components or features that differ in name but not function.

Reference throughout this specification to "embodiment," or similar language means that a particular feature, structure, or characteristic described in connection with the embodiment may be included in at least one embodiment of the present disclosure. Thus, these phrases or similar language throughout this specification may, but do not necessarily, all refer to the same embodiment.

The embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to suggest that the scope of the disclosure, including the claims, is limited to that embodiment.

In addition to the embodiments described above, many examples of specific combinations are within the scope of the disclosure, some of which are detailed below:

Embodiment 1

A method of conducting a well intervention operation in a well, the method comprising:

positioning a conveyance into the well for the well intervention operation;

calculating a predicted force based at least in part on a length of the conveyance that is positioned at a depth in the well;

measuring a measured force for the conveyance at the depth in the well;

comparing the predicted force with the measured force in real time to determine if the predicted force is within a predetermined range of the measured force in real time;

if the predicted force is not within the predetermined range of the measured force, generating an alert; and if the predicted force is within the predetermined range of the measured force, continuing with the well intervention operation.

Embodiment 2

The method of Embodiment 1, further comprising predicting, in real time, a wall friction coefficient for the conveyance within the well based upon known frictional parameters of the conveyance, the well, a previously-run well intervention operation, or any combination thereof.

Embodiment 3

The method of Embodiment 2, wherein calculating the predicted force for the conveyance at a depth in the well is based upon the frictional coefficient.

Embodiment 4

The method of Embodiment 3, further comprising:

updating a value of the wall friction coefficient with a processor in real time, based upon the comparison of the predicted force with the measured force if the predicted force is not within the predetermined range of the measured force; and updating the predicted force for the conveyance, with a processor in real time, at the depth in the well based upon the updated frictional coefficient.

Embodiment 5

The method of Embodiment 4, further comprising:

comparing, with the processor in real time, the updated predicted force for the conveyance at the depth in the well with the measured force in real time to determine if the updated predicted force is within the predetermined range of the measured force.

Embodiment 6

The method of Embodiment 5, further comprising:

continuing with updating the wall friction coefficient, with the processor in real time, based upon the comparison of the updated predicted force with the measured force if the updated predicted force is not within the predetermined range of the measured force; and continuing with updating the predicted force for the conveyance at the depth in the well based upon the updated frictional coefficient.

Embodiment 7

The method of Embodiment 2, further comprising:

preparing a job plan for the well intervention operation based upon the wall friction coefficient for the conveyance within the well;

updating the wall friction coefficient, with the processor in real time, based upon the comparison of the predicted force with the measured force in real time if the predicted force is not within the predetermined range of the measured force; and updating the job plan with the updated wall friction coefficient in real time.

Embodiment 8

The method of Embodiment 7, further comprising:

determining if the updated job plan is within a failure condition, with the processor in real time, for the conveyance or the well intervention operation in real time;

generating the alert if the updated job plan is within the failure condition in real time; and continuing with the well intervention operation if the updated job plan is not within the failure condition.

Embodiment 9

The method of Embodiment 8, wherein the failure condition comprises any one or combination of:

the conveyance experiencing stress above a predetermined amount;

the conveyance experiencing yield above a predetermined amount;

the conveyance prevented from moving within the well; or the conveyance disconnecting from a component within the well.

Embodiment 10

The method of Embodiment 2, wherein the wall friction coefficient for the conveyance within the well comprises a plurality of frictional coefficients for different portions of the conveyance within the well.

Embodiment 11

The method of Embodiment 1, wherein the well intervention operation with the conveyance comprises a drilling operation, a perforating tubing operation, a pumping and stimulation operation, a sand control completion operation, a well control operation, a snubbing operation, a recompletion operation, an abandonment operation, a well evaluation operation, or any combination thereof.

Embodiment 12

The method of Embodiment 1, comprising displaying the comparison of the measured force with regard to the predicted force.

Embodiment 13

A method of conducting a well intervention operation in a well, the method comprising:

calculating a predicted force based at least in part on a length of the conveyance that is positioned at a depth in the well measuring a measured force for a conveyance at the depth in the well;

comparing the predicted force with the measured force in real time to determine if the predicted force is within a predetermined range of the measured force in real time;

continuing with the well intervention operation if the predicted force is within the predetermined range of the measured force;

updating a job plan for the well intervention operation based upon the comparison of the predicted force with the measured force in real time if the predicted force is not within the predetermined range of the measured force;

determining if the updated job plan is within a failure condition for the conveyance or the well intervention operation in real time;

continuing with the well intervention operation if the updated job plan is not within the failure condition; and generating an alert if the updated job plan is within the failure condition in real time.

Embodiment 14

The method of Embodiment 13, wherein the updating the job plan comprises:

preparing the job plan for the well intervention operation based upon a wall friction coefficient for the conveyance within the well;

updating the wall friction coefficient based upon the comparison of the predicted force with the measured force in real time if the predicted force is not within the predetermined range of the measured force; and updating the job plan based upon the updated wall friction coefficient in real time.

Embodiment 15

The method of Embodiment 14, further comprising:

predicting the wall friction coefficient for the conveyance within the well based upon known frictional parameters of the conveyance, the well, a previously-run well intervention operation, or any combinations thereof; and predicting the force for the conveyance at the depth in the well based upon the predicted frictional coefficient.

Embodiment 16

The method of Embodiment 15, further comprising:

updating the wall friction coefficient based upon the comparison of the predicted force with the measured force in real time if the predicted force is not within the predetermined range of the measured force;

updating the predicted force for the conveyance at the depth in the well based upon the updated frictional coefficient.

Embodiment 17

The method of Embodiment 16, further comprising:

comparing the updated predicted force for the conveyance at the depth in the well with the measured force in real time to determine if the updated predicted force is within the predetermined range of the measured force in real time.

Embodiment 18

The method of Embodiment 17, further comprising:

continuing with updating the wall friction coefficient based upon the comparison of the updated predicted force with the measured force if the updated predicted force is not within the predetermined range of the measured force; and continuing with updating the predicted force for the conveyance at the depth in the well based upon the updated frictional coefficient.

Embodiment 19

The method of Embodiment 13, comprising displaying the comparison of the measured force with regard to the predicted force.

Embodiment 20

A system for conducting a well intervention operation in a well, comprising:

a persistent storage comprising:

a predicted force for a conveyance at a depth in the well;

a predetermined range for a measured force;

a job plan for the well intervention operation; and a failure condition for the conveyance or the well intervention operation; and a processor programmed to:

compare, in real time, the predicted force for the conveyance at the depth in the well with the measured force for the conveyance at the depth in the well;

determine, in real time, if the predicted force is within a predetermined range of the measured force;

continue with the well intervention operation if the predicted force is within the predetermined range of the measured force;

update the job plan for the well intervention operation, in real time, based upon the comparison of the predicted force with the measured force if the predicted force is not within the predetermined range of the measured force;

determine if the updated job plan is within the failure condition for the conveyance or the well intervention operation;

continue with the well intervention operation if the updated job plan is not within the failure condition; and generate an alert if the updated job plan is within the failure condition.

Embodiment 21

The device of Embodiment 19, wherein:

the persistent storage further comprises a wall friction coefficient for the conveyance within the well; and the processor is further programmed to:

prepare the job plan for the well intervention operation based upon the wall friction coefficient for the conveyance within the well;

update the wall friction coefficient based upon the comparison of the predicted force with the measured force if the predicted force is not within the predetermined range of the measured force; and update the job plan based upon the updated frictional coefficient.

Embodiment 22

The device of Embodiment 21, wherein the processor is further programmed to display the comparison of the measured force with regard to the predicted force

What is claimed is:

1. A method of conducting a well intervention operation in a well, the method comprising:

positioning a length of a conveyance into the well for the well intervention operation; calculating, with the computing device, a predicted force placing the length of the conveyance in compression or tension and based at least in part on the length of the conveyance positioned in the well;

measuring a measured force placing the length of the conveyance in compression or tension for the conveyance positioned in the well;

comparing the predicted force to the measured force in real time to determine if the predicted force is within a predetermined range of the measured force in real time;

if the predicted force is not within the predetermined range of the measured force, updating the predicted force for the length of the conveyance in the well with the computing device in real time until the predicted force is within the predetermined range;

preparing a job plan for the well intervention operation;

determining if the job plan is within a failure condition with the computing device based on the predicted force; and generating an alert if the updated job plan is within the failure condition in real time.

2. The method of claim 1, further comprising predicting, in real time, a wall friction coefficient for the conveyance within the well based upon known frictional parameters of the conveyance, the well, a previously-run well intervention operation, or any combination thereof.

3. The method of claim 2, wherein calculating the predicted force for the conveyance at a depth in the well is based upon the wall friction coefficient.

4. The method of claim 3, further comprising:

updating a value of the wall friction coefficient with a processor in real time, based upon the comparison of the predicted force with the measured force if the predicted force is not within the predetermined range of the measured force; and updating the predicted force for the conveyance, with a processor in real time, based upon the updated frictional coefficient.

5. The method of claim 4, further comprising comparing, with the processor in real time, the updated predicted force for the conveyance with the measured force in real time to determine if the updated predicted force is within the predetermined range of the measured force.

6. The method of claim 5, further comprising:

continuing with updating the predicted wall friction coefficient, with the processor in real time, based upon the comparison of the updated predicted force with the measured force if the updated predicted force is not within the predetermined range of the measured force; and continuing with updating the predicted force for the conveyance based upon the updated predicted wall frictional coefficient.

7. The method of claim 1, further comprising:

preparing the job plan based upon the wall friction coefficient for the conveyance within the well;

updating the wall friction coefficient, with the processor in real time, based upon the comparison of the predicted force with the measured force in real time if the predicted force is not within the predetermined range of the measured force; and updating the job plan with the updated wall friction coefficient in real time.

8. The method of claim 7, further comprising:

determining if the updated job plan is within the failure condition, with the processor in real time, for the conveyance or the well intervention operation in real time;

generating the alert if the updated job plan is within the failure condition in real time; and continuing with the well intervention operation if the updated job plan is not within the failure condition.

9. The method of claim 8, wherein the failure condition comprises any one or combination of:

the conveyance experiencing stress above a predetermined amount;

the conveyance experiencing yield above a predetermined amount;

the conveyance prevented from moving within the well; or the conveyance disconnecting from a component within the well.

10. The method of claim 2, wherein the wall friction coefficient for the conveyance within the well comprises a plurality of frictional coefficients for different portions of the conveyance within the well.

11. The method of claim 1, wherein the well intervention operation with the conveyance comprises a drilling operation, a perforating tubing operation, a pumping and stimulation operation, a sand control completion operation, a well control operation, a snubbing operation, a recompletion operation, an abandonment operating, a well evaluation operation, or any combination thereof.

12. The method of claim 1, comprising displaying the comparison of the measured force with regard to the predicted force.

13. A method of conducting a well intervention operation in a well, the method comprising:

positioning a length of a conveyance into the well for the well intervention operation;

predicting, with a computing device, a wall friction coefficient for the length of conveyance within the well based upon known frictional parameters of the conveyance, the well, a previously-nm well intervention operation, or any combination thereof;

calculating a predicted force placing the conveyance in compression or tension and based at least in part on a length of the conveyance positioned a in the well and the predicted wall friction coefficient;

measuring a measured force placing the conveyance in compression or tension for the conveyance in the well;

comparing the predicted force to the measured force in real time to determine if the predicted force is within a predetermined range of the measured force in real time;

if the predicted force is not within the predetermined range of the measured force, updating a value of the predicted wall friction coefficient based upon the comparison of the predicted force to the measured force and updating the predicted force for the conveyance at the depth in the well based upon the updated predicted wall friction coefficient with the computing device in real time until the predicted force is within the predetermined range;

updating a job plan for the well intervention operation based upon the comparison of the predicted force to the measured force in real time if the predicted force is not within the predetermined range of the measured force;

determining if the updated job plan is within a failure condition for the conveyance or the well intervention operation in real time;

continuing with the well intervention operation if the updated job plan is not within the failure condition; and generating an alert if the updated job plan is within the failure condition in real time.

14. The method of claim 13, wherein the updating the job plan comprises:

preparing the job plan for the well intervention operation based upon the predicted wall friction coefficient for the conveyance within the well;

updating the predicted wall friction coefficient based upon the comparison of the predicted force to the measured force in real time if the predicted force is not within the predetermined range of the measured force; and updating the job plan based upon the updated predicted wall friction coefficient in real time.

15. The method of claim 13, further comprising comparing the updated predicted force for the conveyance to the measured force in real time to determine if the updated predicted force is within the predetermined range of the measured force in real time.

16. The method of claim 13, comprising displaying the comparison of the measured force with regard to the predicted force.

17. A system for conducting a well intervention operation in a well, comprising:

a conveyance, a length of which is positionable in the well;

a persistent storage comprising:

a predicted force placing the length of the conveyance positioned in the well in compression or tension;

a predicted wall friction coefficient for the length of the conveyance within the well based upon known frictional parameters of the conveyance, the well, a previously-run well intervention operation, or any combination thereof;

a predetermined range for a measured force placing the length of the conveyance in compression or tension;

a job plan for the well intervention operation; and a failure condition for the conveyance or the well intervention operation; and a processor programmed to:

compare, in real time, the predicted force for the conveyance to the measured force for the conveyance;

determine, in real time, if the predicted force is within a predetermined range of the measured force;

continue with the well intervention operation if the predicted force is within the predetermined range of the measured force;

update, if the predicted force is not within the predetermined range of the measured force, a value of the predicted wall friction coefficient based upon the comparison of the predicted force to the measured force and update the predicted force for the conveyance at the depth in the well based upon the updated predicted wall friction coefficient in real time until the predicted force is within the predetermined range;

update the job plan for the well intervention operation, in real time, based upon the comparison of the predicted force to the measured force if the predicted force is not within the predetermined range of the measured force;

determine if the updated job plan is within the failure condition for the conveyance or the well intervention operation;

continue with the well intervention operation if the updated job plan is not within the failure condition; and generate an alert if the updated job plan is within the failure condition.

18. The device of claim 17, wherein the processor is further programmed to:

prepare the job plan for the well intervention operation based upon the predicted wall friction coefficient for the conveyance within the well;

update the predicted wall friction coefficient based upon the comparison of the predicted force to the measured force if the predicted force is not within the predetermined range of the measured force; and update the job plan based upon the updated predicted wall frictional coefficient.

19. The device of claim 18, wherein the processor is further programmed to display the comparison of the measured force to the predicted force on a display.

20. The method of claim 1, further comprising:

if the predicted force is not within the predetermined range of the measured force, generating an alert with the computing device; and if the predicted force is within the predetermined range of the measured force, continuing with the well intervention operation.

* * * * *